United States Patent [19]

Burford et al.

[11] 4,057,009

[45] Nov. 8, 1977

[54] DOWNSTROKE BALER

[75] Inventors: Charles E. Burford; Joe E. West, both of Dallas, Tex.

[73] Assignee: Burford Corporation, Dallas, Tex.

[21] Appl. No.: 605,944

[22] Filed: Aug. 19, 1975

[51] Int. Cl.[2] ..... B30B 15/24

[52] U.S. Cl. ..... 100/46; 100/50; 100/53; 100/218; 100/258 A; 100/269 R

[58] Field of Search ..... 91/177; 83/624, 639; 72/441, 453; 100/240, 46, 258, 53, 214, 245, 218, 50, 256, 269 R, 255, 3

[56] References Cited

U.S. PATENT DOCUMENTS

| | | | |
|---|---|---|---|
| 2,377,007 | 5/1945 | Hess | 100/258 A |
| 2,462,815 | 2/1949 | Sedgwick | 100/269 R |
| 2,484,908 | 10/1949 | Purcell | 100/258 A |
| 2,915,961 | 12/1959 | Parkinson | 100/258 R |
| 3,664,174 | 5/1972 | Hanni | 100/258 A |
| 3,757,680 | 9/1973 | Williams | 100/258 A |
| 3,851,577 | 12/1974 | Newcom | 100/218 |
| 3,861,296 | 1/1975 | Clar | 100/53 |

*Primary Examiner*—Billy J. Wilhite
*Attorney, Agent, or Firm*—Howard E. Moore; Gerald G. Crutsinger; Larry B. Dwight

[57] ABSTRACT

A downstroke baler comprising a compaction chamber through which a platen is reciprocated vertically by spaced pressure actuated cylinders secured to opposite ends of the platen. The lower end of an actuating rod rests upon a support plate secured to the frame of the baler and a bracket secured to the frame of the baler is positioned adjacent the upper end of the actuating rod to restrain the actuating rod against vertical movement. A sleeve is secured to the platen and slides along the actuating rod such that the actuating rod is maintained perpendicular to the face of the platen. The upper end of the actuating rod is connected through an actuating link to valves secured to the frame of the baler. The valves control a hydraulic circuit connected to the cylinders which raise and lower the platen such that movement of the platen from a horizontal attitude causes the actuating rod to be moved from a vertical attitude thereby changing flow of fluid to the cylinders to return the platen to a horizontal attitude. The rod ends of the cylinders are in continuous communication with the source of pressurized fluid. A valve between the source of pressurized fluid and base ends of the cylinders is shiftable to a first position to direct pressurized fluid to the base ends of the cylinders to elevate the platen and is shiftable to a second position venting base ends of the cylinders to move the platen downwardly.

7 Claims, 4 Drawing Figures

DOWNSTROKE BALER

BACKGROUND

Bale forming apparatus heretofore devised for baling recycleable waste products such as paper, cardboard and similar materials has been unduly complicated in structure. The ratio of the size of the bale forming apparatus, as compared to the size of the bale formed thereby, has been excessive.

In view of overhead space limitations in office buildings, warehouses, and other areas in which recycleable waste products are accumulated, and preferably baled prior to transporting to a refuse collection center; bale forming apparatus generally employed heretofore has had a horizontally reciprocating platen moveable through a horizontally disposed compaction chamber to form bales. Horizontal balers occupy excessive floor space and do not effectively utilize available overhead space.

A major difficulty encountered in bale forming apparatus, incorporating a vertically reciprocating platen having an outer periphery spaced closely to walls of the compaction chamber, has involved maintaining the face of the platen in a horizontal attitude to prevent wedging the platen between walls of the compaction chamber when force resisting movement of the platen is irregularly imposed against the face of the platen.

Heretofore platen leveling devices have included liquid filled leveling switches connected to solenoid actuated hydraulic circuits for controlling flow of fluid to cylinders urging the platen downwardly. Electrically actuated platen leveling systems heretofore devised are undesirable for utilization in baling certain types of refuse because dust, moisture and other foreign matter tend to foul or prevent actuation of delicate switching apparatus. Another disadvantage of electrically actuated platen leveling systems heretofore devised results from the inability of the leveling system to continuously sense and adjust flow of pressurized fluid to cylinders actuating the platen. The systems have employed electrical circuits, which are either open or closed, which results in constant hunting of the platen causing the platen to continuously tilt first in one direction and then in the other.

SUMMARY

The baling apparatus described herein comprises a platen which is moved vertically through a compaction chamber by spaced double-acting pressure actuated cylinders secured to opposite ends of the platen. The base of each cylinder is secured to the lower end of the frame of the bale forming apparatus and piston rods, extending from rod ends of the cylinders, extend upwardly to the platen. Thus, the platen is pulled downwardly by the cylinders minimizing the necessity for structure which tends to increase the heighth of the bale forming apparatus.

Four cam actuated deceleration type valves are simultaneously actuated by a mechanical platen leveling mechanism, including a freely floating rod extending through a sleeve secured to the platen. When force resisting movement of the platen tends to tilt the platen out of a horizontal plane, the freely floating rod is instantly moved thereby changing the flow passages through the cam actuated valves, thereby adjusting flow of pressurized fluid to or from the cylinders. Therefore, the mechanical leveling mechanism continuously senses the attitude of the platen and instantaneously adjusts flow only to the extent required to maintain the platen in a horizontal attitude to overcome irregularly distributed resistance to downward movement of the platen.

An improved hydraulic circuit is employed for raising and lowering the platen through the compaction chamber. Rod ends of the hydraulic cylinders are maintained in constant communication with the pressure side of a pump, or other suitable source of pressurized fluid, while base ends of the cylinders are alternately pressurized and vented for moving the platen vertically. When the rod end and the base end of each cylinder are pressurized to the same pressure, the surface area of the piston on the rod end of the cylinder is less than the surface area of the piston on the base end of the cylinder such that a resultant force is applied to the piston for moving the platen upwardly. Upon venting the base end of the cylinder the pressurized fluid in the rod end of the cylinder urges the piston and the platen attached thereto downwardly through the compaction chamber.

A primary object of the invention is to provide a downstroke baler having an improved mechanically actuated platen leveling circuit which continuously senses the attitude of the platen and continuously adjusts flow of fluid to pressure actuated cylinders which move the platen through a compaction chamber.

Another object of the invention is to provide a downstroke baler having an improved hydraulic circuit connected to pressure actuated cylinders which move a platen through a compaction chamber wherein the necessity for providing valves for venting the rod end of the pressure actuated cylinders for moving the platen is eliminated.

A further object of the invention is to provide a downstroke baler having cylinders mounted to pull a platen downwardly through a compaction chamber such that the heighth of the baler structure is minimized providing a minimum ratio between the overall dimensions of the bale forming apparatus and the dimensions of the bale to be formed.

Other and further objects of the invention will become apparent upon referring to the detailed description hereinafter following and to the drawings annexed hereto.

DESCRIPTION OF DRAWING

Drawings of a preferred embodiment of the invention are annexed hereto so that the invention may be better and more fully understood, in which.

Numeral references are employed to designate like parts throughout the various figures of the drawing.

PREFERRED EMBODIMENT

Figure 1:
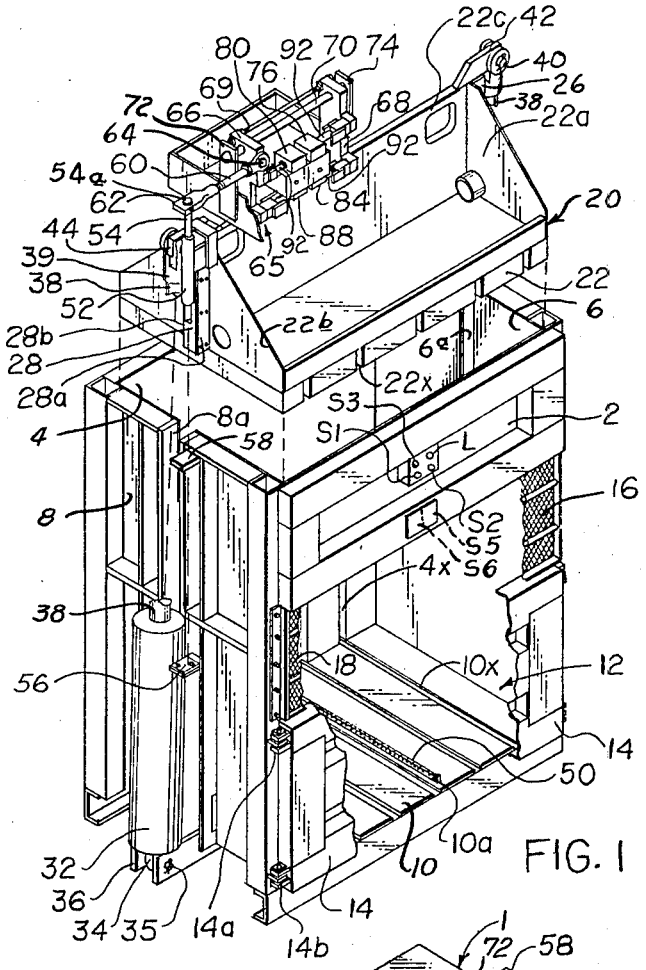
FIG. 1 is a partially exploded front perspective view of the bale forming apparatus, parts being broken away to more clearly illustrate details of construction.

Referring to FIG. 1 of the drawing, the numeral 1 generally designates bale forming apparatus comprising spaced parallel front and back walls 2 and 4 connected by spaced parallel end walls 6 and 8. A horizontally disposed floor 10 is secured across lower ends of walls 2–8 forming a general frame about compaction chamber 12.

A chamber door 14 is pivotally secured by hinges 14*a* and 14*b* to end wall 8 and suitable latching means is secured to end wall 6 for detachably securing door 14 in a closed position.

Upper chamber closure doors 16 and 18 are hingedly secured to end walls 6 and 8, respectively, to facilitate loading material to be compacted into compaction chamber 12. As will be hereinafter more fully explained safety switches S5 and S6 are positioned on the front wall 2 to be actuated by doors 16 and 18.

A platen 20 is mounted for vertical reciprocation through the upper portion of compaction chamber 12.

Platen 20 comprises a rectangularly shaped, horizontally disposed, pressure plate 22 forming a moveable upper wall of compaction chamber 12.

Pressure plate 22 is suitably reinforced to provide structural strength, as by end plates 22*a* and 22*b* having a stiffening rib 22*c* extending therebetween. Platen guide members 26 and 28 are secured to each end of platen 20, as by welding. Platen guide members 26 and 28 have vertically disposed faces 26*a* and 26*b* and 28*a* and 28*b* which are perpendicular to opposite sides of the horizontally disposed lower surface of pressure plate 22.

End walls 6 and 8 of bale forming apparatus 1 have vertically disposed guide slots 6*a* and 8*a* formed therein and platen guide elements 26 and 28 are slideably disposed in the guide slots.

It should be appreciated that the elongated guide members 26 and 28, slideably disposed in slots 6*a* and 8*a*, restrain platen 20 against rotation about a horizontal axis extending transversally of compaction chamber 12 between end walls 6 and 8.

Double-acting pressure actuated cylinders 30 and 32 have base ends pivotally secured to the lower end of end walls 6 and 8 of bale forming apparatus 1 by pins 35 extending through apertures in ear 34 and lugs 36. Each of the cylinders 30 and 32 has a piston slideably disposed therein to which a piston rod 38 is secured. Piston rods 38 extend outwardly from the rod ends of cylinders 30 and 32, and the upper ends of rods 38 are pivotally secured by pins 40 to an end of platen 20. Each rod 38 has a clevis 39 on the end thereof having an aperture through which pin 40 extends. Connector lugs 42 and 44 are secured to opposite ends of platen 20 adjacent the upper end of guide members 26 and 28 and have apertures formed therein through which pin 40 extends.

Upper and lower platen limit switches S7 and S8 are secured to the end wall 6 of the bale forming apparatus to be actuated by platen 20, as will be hereinafter more fully explained.

Figure 2:
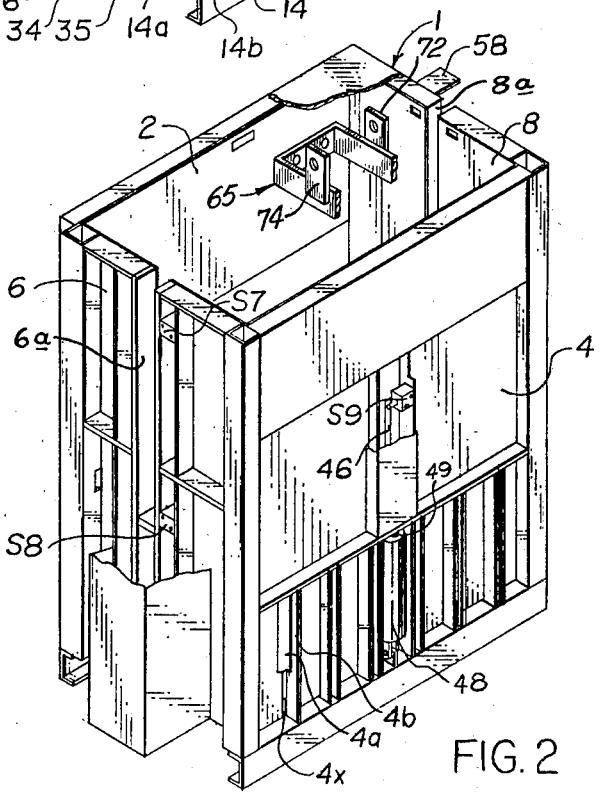
FIG. 2 is a rear perspective view of the bale forming apparatus, parts being broken away to more clearly illustrate details of construction.

As best illustrated in FIG. 2, the back wall 4 of bale forming apparatus 1 has a slot 46 formed therein. A double-acting pressure actuated cylinder 48 has a base end pivotally secured to a lower portion of the frame of the baler apparatus and the upper end of piston rod 49 is secured to a flexible bale ejector member 50, such as a chain, cable, or rope. The ejector member 50 extends through a slot 46 in back wall 4, downwardly along the back wall to the floor 10, and along floor 10 to lug 10*a* adjacent chamber door 14.

From the foregoing it should be readily apparent that when rod 49 is extended from cylinder 48, flexible ejector member 50 is elevated thereby elevating the rear edge of the bale causing the bale to be rolled from compaction chamber 12.

As will be hereinafter more fully explained, a limit switch S9 is secured to back wall 4 to be actuated when piston rod 49 is fully extended.

Referring to FIGS. 1 and 2 of the drawing, it should be noted that floor 10 of the bale forming apparatus has spaced grooves 10*x* formed therein substantially parallel to end walls 6 and 8. The back wall 4 has slots 4*x* extending therethrough and, as illustrated in FIG. 2, stiffener ribs 4*a* and 4*b* extend vertically along opposite sides of each of the slots 4*x*. The lower face of the pressure plate 22 on platen 20 has grooves 22*x* which are aligned vertically above grooves 10*x* in floor 10. Grooves 10*x* and 22*x* and slots 4*x* are arranged such that after a bale has been formed and while pressure plate 22 is maintained in engagement with the upper surface of the bale, tie wires can be positioned about the bale by inserting the wire through grooves 10*x* and 22*x* and tying free ends thereof. After platen 20 has been elevated, rod 49 of ejector cylinder 48 is extended for rolling the tied bale from the compaction chamber 12.

As best illustrated in FIG. 1 of the drawing, an elongated sleeve 52 is secured to guide member 28 on platen 20. Sleeve 52 has a central axis which is vertically disposed and parallel to a central axis extending vertically through a central portion of compaction chamber 12. The axis of sleeve 52 is perpendicular to the lower face of pressure plate 22 on platen 20 as will be hereinafter more fully explained.

An actuating rod 54 is slideably disposed in the passage through sleeve 52 and is maintained perpendicular to the plane of the lower face of pressure plate 22.

A support plate 56 is secured to wall 8 of bale forming apparatus 1 for supporting the lower end of actuating rod 54. Actuating rod 54 is restrained against vertical movement by support plate 56 and a bracket 58 secured to end wall 8 vertically above support plate 56.

A valve actuating link 60 has a leveling yoke 62 secured to an outer end thereof. Leveling yoke 62 has a central aperture through which the upper end 54*a* of actuating rod 54 extends. When the upper end 54*a* of actuating rod 54 is positioned through the aperture in leveling yoke 62, valve actuating link 60 is perpendicularly disposed relative to actuating rod 54 and thus lies in a plane spaced from but parallel to the plane of the lower face of pressure plate 22.

The inner end of valve actuating link 60 has an aperture formed in the end thereof and is pivotally secured by bolt 64 to a cam assembly 65.

Cam assembly 65 comprises cam elements 66 and 68 rigidly secured together by a tie rod 69. Cam elements 66 and 68 are slideably disposed on support bar 70 having opposite ends supported by brackets 72 and 74 secured to the frame of the baling apparatus 1.

As will be hereinafter more fully explained, valves 76, 80, 84 and 88 are preferably cam operated deceleration type flow control valves having variable size flow passages, the size of each flow passage being adjustable upon movement of valve element actuating arm 92. Each actuating arm 92 is urged outwardly by a spring element (not shown) in the valve body. Cam elements 66 and 68 engage the ends of actuating arms 92 such that flow passages in valves 80 and 88 are simultaneously enlarged while flow passages through valves 76 and 84 are simultaneously reduced upon movement of cam elements 66 and 68 to the left as viewed in FIG. 1.

Figure 3:
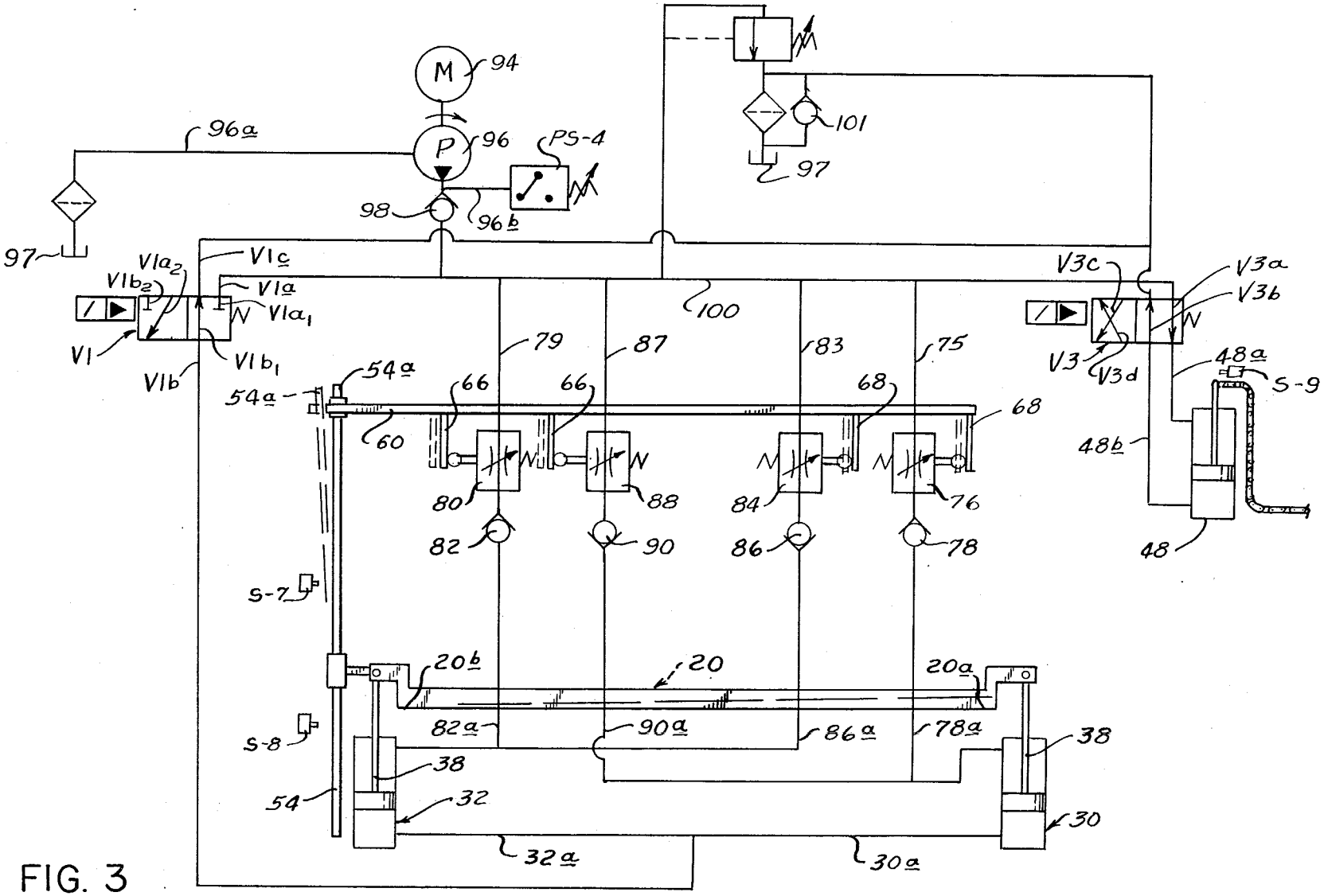
FIG. 3 is a schematic view of the hydraulic control circuit.

A schematic diagram of the hydraulic control circuit is illustrated in FIG. 3 of the drawing.

A source of power such as electric motor 94 is drivingly connected to a gear type fixed displacement unidirectional hydraulic pump 96 having a suction side drawing hydraulic fluid through line 96*a* from a reservoir 97. As will be hereinafter more fully explained, the high pressure outlet of pump 96 is connected through line 96*b* to a pressure switch PS4. Pressure required to actuate switch PS4 is adjustable to establish the density to which material is compacted by platen 20 to form a bale. When the normally closed contacts of pressure switch PS4 are opened while platen 20 is moving downwardly, motor 94 will be automatically de-energized.

Pressurized fluid from hydraulic pump 96 is delivered through a check valve 98 to a manifold 100.

Manifold 100 is connected through line 75 to flow control valve 76, through line 79 to valve 80, through line 83 to valve 84, and through line 87 to valve 88.

Valve 76 is connected through an outwardly opening check valve 78 and line 78*a* to the rod end of cylinder 30. Valve 88 is connected through inwardly opening check valve 90 and line 90*a* to the rod end of cylinder 30.

Valve 80 is connected through outwardly opening check valve 82 and line 82*a* to the rod end of cylinder 32. Valve 84 is connected through inwardly opening check valve 86 and line 86*a* to the rod end of cylinder 32.

It should be readily apparent that valves 76 and 88 are connected in parallel. Fluid flowing to the rod end of cylinder 30 passes through flow control valve 76 outwardly opening check valve 78. Fluid flowing out of the rod end of cylinder 30 passes through inwardly opening check valve 90 and is metered through flow control valve 88.

It should also be apparent that valves 80 and 84 are connected in parallel. Fluid flowing to the rod end of cylinder 32 is metered through flow control valve 80 and check valve 82. Fluid flowing out of the rod end of cylinder 32 passes through inwardly opening check valve 86 and is metered through flow control valve 84.

A two-position, three-way solenoid actuated valve V1 has three ports: port V1*a,* communicating with manifold 100; port V1*b,* communicating with lines 30*a* and 32*a* leading to base ends of cylinders 30 and 32, respectively; and port V1*c,* communicating with reservoir 97 through an outwardly opening check valve 101.

The valve element in valve V1 has an internally blocked passage V1al which communicates with port V1*a*when valve V1 is in the home position illustrated in FIG. 3. The valve element has a passage V1b1 for connecting ports V1*b* and V1*c* when the valve element is in the home position illustrated in FIG. 3.

The valve element has a passage V1a2 which connects ports V1*a* and V1*b* when the valve element is shifted to the right from the position illustrated in FIG. 3 such that pressurized fluid is delivered from manifold 100 to base ends of cylinders 30 and 32. When the valve element of valve V1 is actuated to the right from the position illustrated in FIG. 3, port V1*c* is blocked.

It should be appreciated that when Valve V1 is in the home position, illustrated in FIG. 3, base ends of cylinders 30 and 32 are vented through passage V1b1 of valve V1 to reservoir 97, while the rod ends of cylinders 30 and 32 are pressurized by flow through cam actuated adjustable flow control valves 76 and 80. Thus, pistons in cylinders 30 and 32 are urged downwardly moving platen 20 downwardly.

When valve V1 is shifted to the right from the position illustrated in FIG. 3, pressurized fluid from manifold 100 is delivered through passage V1a2 to the base ends of cylinders 30 and 32 and pressurized fluid is delivered from a manifold 100 to the rod ends of cylinders 30 and 32, as hereinbefore described. However, since the entire lower surface area of pistons in cylinders 30 and 32 is acted upon by pressure in base ends of cylinders 30 and 32, the pistons are urged upwardly because fluid in the rod ends of cylinders 30 and 32 acts upon a surface area which is equal to the lower surface area of the pistons less the cross-sectional area of piston rods 38.

Fluid flowing from the rod ends of cylinders 30 and 32 is controlled by cam actuated flow control valves 84 and 88.

A two-position, four-way solenoid actuated valve V3 has flow passages V3*a,* V3*b,* V3*c,* and V3*d.*

When valve V3 is in the home position illustrated in FIG. 3, pressure manifold 100 is in communication through passage V3*a* with line 48*a* connected to the rod end of ejector cylinder 48. When valve V3 is in the home position illustrated in FIG. 3, the base end of ejector cylinder 48 is connected through line 48*b* and passage V3*b* to reservoir 97.

When valve V3 is actuated to the right from the position illustrated in FIG. 3, pressure manifold 100 is connected through passage V3*c* to the base end of ejector cylinder 48 through line 48*b,* and the rod end of cylinder 48 is connected through line 48*a* and passage V3*d* to reservoir 97.

Figure 4:
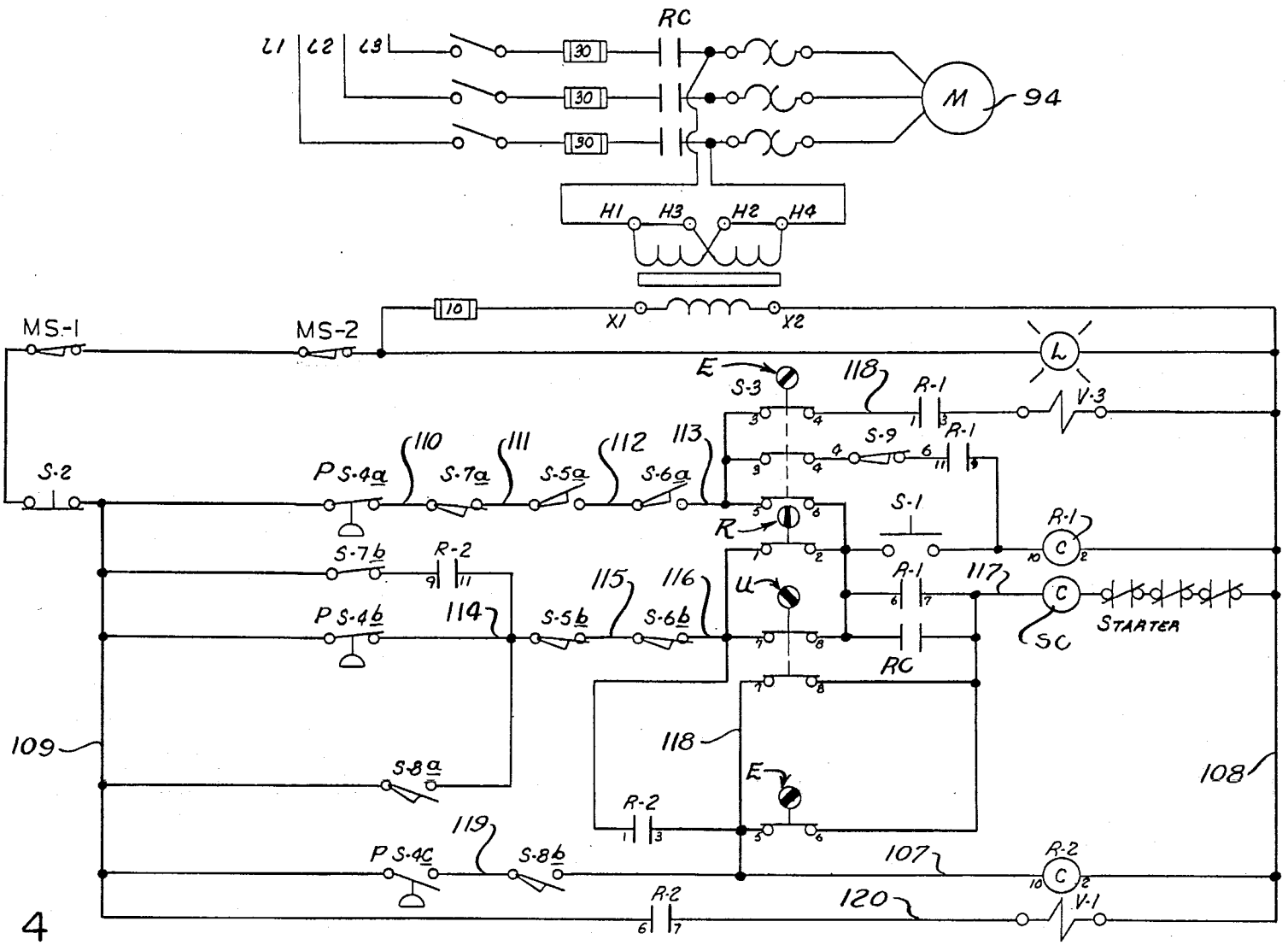
FIG. 4 is a schematic view of the electrical circuit.

Referring to FIG. 4 of the drawing, the electrical components comprise mercury switches MS1 and MS2; start switch S1; stop switch S2; selector switch S3, pressure switch PS4; door safety switches S5 and S6, upper platen limit switch S7; lower platen limit switch S8; ejector switch S9; relays R1 and R2; and indicator lamp L.

Mercury switches MS1 and MS2 are secured to platen 20 to prevent energization of electric motor 94 if pressure plate 22 of platen 20 is not in a horizontal attitude.

Start switch S1 is a spring opened push button type switch for momentarily closing an electrical circuit.

Stop switch S2 is a spring closed push button switch to momentarily break the electrical circuit.

Selector switch S3 is a three-position, multi-contact combination switch. When switch S3 is in the run position R, an electrical circuit is completed between contacts 1 and 2 of switch S3, all other circuits through switch S3 being open. When selector switch S3 is in the eject position E, circuits are completed between contacts 3 and 4, and between contacts 5 and 6, all other circuits through selector switch S3 being open. When selector switch S3 is in the raise position U, an electrical circuit is completed between contacts 7 and 8 of switch S3, the other circuits through switch S3 being open.

Each of the three positions of selector switch S3 are illustrated in FIG. 4 of the drawing. The position of poles closing circuits at the various positions of selector switch S3 are indicated as follows: eject position E, run position R, and raise position U.

Pressure switch PS4 has an adjustable opening pressure to control the maximum force urging platen 20 downwardly. Pressure switch PS4 has normally closed contacts PS4*a* and PS4*b* which open on rising pressure and normally open contacts PS4*c* which close on rising pressure. Pressure switch PS4 senses hydraulic pressure to terminate downward movement of platen 20.

Door safety switchs S5 and S6 are limit switches having contacts S5*a* and S6*a* which are normally closed and contacts S5*b* and S6*b* which are normally open. Limit switches S5 and S6 are actuated by the upper chamber closure doors 16 and 18. If doors 16 and 18 are open when selector switch S3 is in the run position R, or in the raise position U, electric motor 94 cannot be energized. Switches S5 and S6 prevent energization of electric motor 94 if doors 16 and 18 are closed while selector switch S3 is in the eject position E.

Upper platen limit switch S7 and lower platen limit switch S8 are mounted on end wall 6 of baler apparatus 1 and are actuated by platen 20.

Upper platen limit switch S7 prevents initiation of an ejection cycle if platen 20 is not in a fully raised position. Limit switch S7 also de-energizes motor 94 when platen 20 reaches the fully raised position.

Lower platen limit switch S8 forms a holding circuit to electric motor 94 when pressure switch PS4 is actuated before the bale size and density is reached. Lower platen limit switch S8 also completes a circuit to energize the coil of relay R2 to energize the solenoid for shifting valve V1 to cause platen 20 to move upwardly.

Ejection switch S9 is a normally closed limit switch for energizing the coil of ejector valve V3 to retract the rod of ejector cylinder 48.

Relay R1 has normally open contacts 6 and 7 which are closed to provide a path for current to pass to the starter coil SC of electric motor 94. Normally open contacts 9 and 11 of relay R1 provide a holding circuit for the coil of relay R1. Normally open contacts 1 and 3 of relay R1, when closed complete a circuit to energize the solenoid of ejector valve V3.

The coil of relay R2 is energized to initiate the upstroke of platen 20. Holding circuits are formed through contacts 1 and 3 and contacts 9 and 11 of relay R2. Contacts 6 and 7 of relay R2 are in series with the coil of the solenoid actuated valve V1 for causing pressurized fluid to be delivered to the lower end of cylinders 30 and 32 when contacts 6 and 7 of relay R2 are closed.

The indicator lamp L is illuminated to indicate that electric power is being delivered to the electrical circuit.

The operation and function of the apparatus hereinbefore described is as follows:

With the lower chamber door 14 closed and upper chamber closure doors 16 and 18 open, material to be compacted is deposited in compaction chamber 12 while the platen 20 is in the raised position. Upon closing doors 16 and 18, the normally open contacts S5*b* and S6*b* of limit switches S5 and S6 are held closed.

When selector switch S3 is in the run position R, an electrical circuit is completed from line 109, through the normally closed contact PS4*b* of pressure switch PS4, through line 114, contacts S5*b* of limit switch S5, line 115, contacts S6*b* of limit switch S6, through line 116, through contacts 1 and 2 of selector switch S3 to start switch S1. When start switch S1 is closed, the coil of relay R1 is energized which closes normally open contacts 6 and 7 of relay R1 and energizes the coil SC of the motor starter through line 117. An internal set of starter contacts RC are closed to provide a holding circuit for the starter coil SC. When selector switch S3 is in the run position R, the circuit through the coil of relay R1 is broken when the start switch S1 is released.

The solenoid valves V1 and V3 are de-energized. Therefore, base ends of cylinders 30 and 32 are vented to atmosphere through passage V1b1 of valve V1.

Thus, the momentary closing of start switch S1 energizes motor 94 such that pressurized fluid is delivered from pump 96 through manifold 100 and valves 76 and 80 to the rod ends of cylinders 30 and 32 moving platen 20 downwardly.

If the density of the material being compacted to form a bale is not sufficiently high for tying, platen 20 will move downwardly to close normally open contacts S8*a* and S8*b* of lower platen limit switch S8. When hydraulic pressure reaches a level sufficient to actuate pressure switch PS4, contacts PS4*c* will close completing an electrical circuit from line 109, through closed contacts PS4*c,* closed limit switch contacts S8*b,* through the coil of relay R2 to line 108. When the coil of relay R2 is energized, a holding circuit through the coil is formed from line 109, through contacts S7*b,* contacts 9 and 11 of relay R2, through contacts S5*b* and S6*b* of upper door switches S5 and S6, through contacts 1 and 3 of relay R2 and through line 107 to the coil of relay R2.

When the coil of relay R2 is energized through the holding circuit, contacts 6 and 7 of relay R2 are held closed completing a circuit from line 109 through line 120 to energize the coil of valve V1.

When the coil of valve V1 is energized, pressurized fluid is directed simultaneously to the rod ends and the base ends of cylinders 30 and 32. However, since the surface area of the piston in the rod end of each cylinder is less than the surface area acted upon by the fluid in the base end of each cylinder, the pistons in cylinders 30 and 32 move upwardly causing platen 20 to move upwardly until limit switch S7 is actuated. When contacts S7*b* of limit S7 open, the holding circuit hereinbefore described to the coil of relay R2 is broken which results in opening contacts 6 and 7 of relay R2 to de-energize the coil of solenoid actuated valve V1. When the coil of valve V1 is de-energized, valve V1 returns to the home position illustrated in FIG. 3 causing base ends of cylinders 30 and 32 to be vented to atmosphere through passage V1b1 of valve V1.

When contacts S7*b* of upper platen limit switch S7 are open, motor 94 is de-energized thereby stopping pump 96 and causing platen 20 to remain in the raised position until start switch S1 is manually closed to initiate another cycle of operation.

If material being compacted to form a bale exerts sufficient force upon platen 20 while the platen is being urged downwardly, contacts PS4*b* of pressure switch PS4 will be opened which breaks the holding circuit through starter contacts RC and causes motor 94 to be de-energized. When motor 94 is de-energized pump 96 is stopped and platen 20 will remain in the lowered position if lower platen limit switch S8 has not been actuated.

When platen 20 stops in the lowered position and motor 94 stops, this indicates that the bale has reached a proper density for tying before platen 20 moved downwardly to actuate switch S8.

Chamber door 14 is then opened and tying material is inserted through grooves 10*x* formed in floor 10 of the bale forming apparatus, through slots 4*x* in backwall 4, and through grooves 22*x* in the lower face of pressure plate 22 of plate 20. Free ends of the tie material may then be tied for securing the bale.

Upon moving selector switch S3 to the raise position U, contacts 7 and 8 of switch S3 are closed and all other circuits through switch S3 are open.

After the bale has been tied and selector switch S3 moved to the raise position V, platen 20 can be elevated by closing start switch S1 for completing a circuit from line 109 through contacts PS4*b* of pressure switch PS4, through line 114, contacts S5*b* and S6*b* of door limit switches S5 and S6, through contacts 7 and 8 of selector switch S3, through start switch S1, to energize the coil of relay R1. When the coil of relay R1 is energized, the coil of the starter is energized through contacts 6 and 7 of relay R1 and a holding circuit through the internal set of contacts RC of the starter relay is formed to provide a holding circuit for the starter coil. Upon opening switch S1, the coil of relay R1 is de-energized. A circuit is completed through line 118 and line 107 to energize the coil of relay R2 thereby closing the contacts 6 and 7 of relay R2 to energize the coil of solenoid actuated valve V1. When the coil of solenoid actuated valve V1 is energized the valve is shifted to the right from the position illustrated in FIG. 3 of the drawing thereby directing pressurized fluid to the base ends and to the rod ends of cylinders 30 and 32 causing the platen 20 to move upwardly until upper platen limit switch S7 is actuated as hereinbefore described.

For removing a bale from compaction chamber 12, selector switch S3 is moved to the eject position E.

It should be noted that upper doors 16 and 18 must be opened to close contacts S5*a* and S6*a* of limit switches S5 and S6. It should also be noted that platen 20 must be in the raised position to close switch S7*a*.

Upon closing start switch S1 an electrical circuit is completed from line 109 through switch PS4*a*, S7*a*, S5*a*, S6*a*, contacts 5 and 6 of selector switch S3, and through start switch S1 to energize the coil of relay R1. Upon energization of the coil of relay R1 contacts 1 and 3 and contacts 9 and 11 of relay R1 are closed completing a circuit from line 113 through contacts 3 and 4 of selector switch S3 and contacts 1 and 3 of relay R1 for energizing the coil of the solenoid actuated valve V3. When valve V3 is shifted to the right from the position illustrated in FIG. 3 of the drawing, pressure from manifold 100 is delivered through passage V3*c* to the base of cylinder 48 thereby moving the rod upwardly such that flexible ejector member 50 elevates the rear edge of the bale and causes the bale to be removed from compaction chamber 12.

When the upper end of the rod 49 of ejection cylinder 48 engages normally closed limit switch S9, the holding circuit to the coil of relay R1 is broken causing contacts 1 and 3 of relay R1 to open breaking the circuit through the solenoid of valve V3. When valve V3 is released the valve element shifts to the position illustrated in FIG. 3 of the drawing directing pressurized fluid from manifold 100 through passage V3*a* to the rod end of ejection cylinder 40*a* moving the piston therein downwardly.

It should also be appreciated that during the ejection cycle the coil of relay R2 is energized by current from line 117 through contacts 5 and 6 of selector switch S3 to line 107. Thus, contacts 6 and 7 of relay R2 are closed during the ejection cycle and valve V1 is shifted to the right from the position illustrated in FIG. 3 to maintain platen 20 in the raised position. However, when the coil of relay R1 is de-energized, the holding circuit to the coil of relay R2 is broken when contacts 6 and 7 of relay R1 are opened opening stop switch S-2 de-energizes motor 94.

As hereinbefore described, cam actuated flow control valves 76, 80, 84 and 88 have variable flow passages which are adjustable upon movement of cam elements 66 and 68.

Referring to FIG. 3 of the drawing, if the end 20*a* of platen 20 is at a higher elevation than the end 20*b*, as illustrated in dashed outline, the upper end 54*a* of actuating rod 54 will move to the left as viewed in FIG. 3. Movement of actuating rod 54 transmits force through actuating link 60 imparting movement to cam elements 66 and 68.

If platen 20 is moving downwardly when the end 20*a* begins moving slower than the end 20*b*, cam element 68 will move inwardly toward valve 76 thereby increasing the size of the flow passage through valve 76 and increasing the rate at which pressurized fluid is delivered to the rod end of cylinder 30. Simultaneously, cam element 66 moves away from flow control valve 80 thereby reducing the size of the flow passage therethrough and reducing the flow rate of pressurized fluid to the rod end of cylinder 32.

If base ends of cylinders 30 and 32 are pressurized when platen 20 begins to assume an attitude other than a horizontal attitude, movement of platen 20 to the position illustrated in dashed outline results in movement of cam element 68 toward flow control valve 84 to increase the size the flow passage therethrough and permitting more rapid flow of fluid from the rod end of cylinder 32. Simultaneously, cam element 66 moves to the left as viewed in FIG. 3 reducing the size of the flow passage through flow control valve 88 and increasing resistance to flow of fluid from the rod end of cylinder 30.

From the foregoing it should be readily apparent that any movement of platen 20 toward a position other than a horizontal attitude, immediately results in slight changes in sizes of passages through cam actuated flow control valves 76, 80, 84 and 88.

From the foregoing it should be readily apparent that the positioning of pressure actuated cylinders 30 and 32 adjacent opposite sides of compaction chamber 12 allows vertical reciprocation of platen 20 while minimizing the vertical dimension of the bale forming apparatus and while minimizing floor space required for operation of the apparatus.

The mechanical linkage between platen 20 and flow control valves 76–88 provides continuous adjustment of flow to and from cylinders 30 and 32 upon any deviation of platen 20 from a horizontal attitude.

It should further be appreciated that the hydraulic circuit illustrated in FIG. 3 expeditiously controls movement of platen 20 during an operating cycle by maintaining rod ends of cylinders 30 and 32 continuously pressurized while permitting base ends of cylinders 30 and 32 to be selectively pressurized or vented.

The preferred embodiments of the invention hereinbefore described and illustrated in the attached drawing accomplishes the objects of the invention. However, it should be appreciated that other and further embodiments may be devised without departing from the basic concept of the invention.

Having described our invention, we claim:

1. Bale forming apparatus comprising: a general frame; a compaction chamber in said general frame, said compaction chamber having a central axis; a platen in said compaction chamber; a pair of pressure actuated cylinders, each of said cylinders having a piston slideably disposed therein and a rod secured to the piston, said rod extending through a rod end of said cylinder, said piston being moveable between the rod end and a base end of said cylinder; means securing a base end of each of said cylinders to said frame adjacent opposite sides of said compaction chamber; means securing said rods to opposite ends of said platen; a source of pressurized fluid; first valve means between said source of pressurized fluid and a first of said cylinders; second valve means between said source of pressurized fluid and said second cylinder; an elongated sleeve; means securing said sleeve to said platen, said sleeve having a central axis which is parallel to the central axis of the chamber when said platen is in a horizontal attitude normal to the central axis of the chamber; an actuating rod extending through said sleeve; means restraining said actuating rod against movement in a direction parallel to the axis of the sleeve; and actuating means between said actuating rod and said first valve means, said actuating means being adapted to actuate said first valve means upon deviation of said platen from an attitude normal to said central axis of the compaction chamber.

2. The combination of claim 1 wherein said first valve means comprises: first and second valves between said source of pressurized fluid and a first of said cylinders, said first and second valves being connected in parallel to the rod end of said first cylinder; a first check valve associated with said first valve permitting flow of fluid to the rod end of said first cylinder; a second check valve associated with said second valve permitting flow of fluid from the rod end of said first cylinder; and wherein said second valve means comprises: third and fourth valves between said source of pressurized fluid and said second cylinder, said third and fourth valves being connected in parallel to the rod end of said second cylinder; a third check valve associated with said third valve permitting flow of fluid to the rod end of said second cylinder; a fourth check valve associated with said fourth valve permitting flow of fluid from the rod end of said second cylinder; and fifth valve means between said source or pressurized fluid and said base end of each of said first and second cylinders, said fifth valve means being shiftable between a first position to deliver pressurized fluid to the base end of said first and second cylinders, and a second position to vent the base ends of said first and second cylinders.

3. The combination of claim 2 with the addition of an ejection cylinder secured to said frame, said ejection cylinder having a piston moveable between a base end and a rod end of the ejection cylinder, and a rod secured to the piston and extending outwardly from the rod end of the ejection cylinder; a flexible bale ejection member secured to the rod of the ejection cylinder and to the frame such that the flexible bale ejection member ejects a bale from the compaction chamber upon extension of the rod of the ejection cylinder; and means selectively connecting opposite ends of said ejection cylinder to said source of pressurized fluid.

4. The combination of claim 1, with the addition of means connecting said source of pressurized fluid to the rod end of each of said cylinders such that pressure of fluid is continuously applied to rod ends of said cylinders.

5. A downstroke bale forming apparatus comprising: a general frame; a vertically disposed compaction chamber in said general frame; a platen in said compaction chamber; a pair of pressure actuated cylinders, each of said cylinders having a piston slideably disposed therein and a rod secured to the piston, said rod extending through a rod end of said cylinder, said piston being moveable between the rod end and a base end of said cylinder; means securing said rods to opposite ends of said platen; means securing the base ends of said first and second cylinders to lower portions of said general frame adjacent opposite sides of said compaction chamber; a source of pressurized fluid; means connecting said source of pressurized fluid to the rod end of said cylinders such that pressure of fluid is continuously applied to rod ends of said cylinders; valve means between said source of pressurized fluid and the base ends of said first and second cylinders, said valve means being shiftable between a first position to direct pressurized fluid to the base ends of said cylinders to elevate said platen, and a second position venting base ends of said cylinders to move the platen downwardly through said compaction chamber; first switching means intermediate opposite ends of said compaction chamber to shift said valve means to said first position; and second switching means adjacent the upper end of said compaction chamber to shift said valve means to said second position.

6. A downstroke bale forming apparatus comprising: a general frame; a vertically disposed compaction chamber in said general frame; a platen in said compaction chamber; a pair of pressure actuated cylinders, each of said cylinders having a piston slideably disposed therein and a rod secured to the piston, said rod extending through a rod end of said cylinder, said piston being moveable between the rod end and a base end of said cylinder; means securing said rods to opposite ends of said platen; means securing the base ends of said first and second cylinders to lower portions of said general frame adjacent opposite sides of said compaction chamber; a source of pressurized fluid; means connecting said source of pressurized fluid to the rod end of said cylinders such that pressure of fluid is continuously applied to rod ends of said cylinders; flow control means between said source of pressurized fluid and said rod ends of said first and second cylinders, said flow control means being adapted to adjust the flow of pressurized fluid to and from said first and second cylinders to maintain said platen in a horizontal plane; and valve means between said source of pressurized fluid and the base ends of said first and second cylinders, said valve means being shiftable between a first position to direct pressurized fluid to the base ends of said cylinders to elevate said platen, and a second position venting base ends of said cylinders to move the platen downwardly through said compaction chamber.

7. A downstroke bale forming apparatus comprising: a general frame; a vertically disposed compaction chamber in said general frame; a platen in said compaction chamber; a pair of pressure actuated cylinders, each of said cylinders having a piston slideably disposed therein and a rod secured to the piston, said rod extending through a rod end of said cylinder, said piston being moveable between the rod end and a base end of said cylinder; a pair of guide members; means securing one of said guide members to each end of said platen; said compaction chamber having a vertically extending slot formed in each side thereof, said guide members being slideably disposed in said slots such that said platen is restrained against rotation about a horizontal axis extending between said guide members; connector lugs secured to opposite ends of said platen adjacent upper ends of said guide members; means securing rods of said first and second cylinders to said connector lugs; means securing the base ends of said first and second cylinders to lower portions of said general frame adjacent opposite sides of said compaction chamber; a source of pressurized fluid; means connecting said source of pressurized fluid to the rod end of said cylinders such that pressure of fluid is continuously applied to rod ends of said cylinders; and valve means between said source of pressurized fluid and the base ends of said first and second cylinders, said valve means being shiftable between a first position to direct pressurized fluid to the base ends of said cylinders to elevate said platen, and a second position venting base ends of said cylinders to move the platen downwardly through said compaction chamber.

* * * * *